US010823367B1

(12) United States Patent
Patterson et al.

(10) Patent No.: US 10,823,367 B1
(45) Date of Patent: Nov. 3, 2020

(54) MODULAR LED LIGHT FIXTURE WITH SPACED DIFFUSER

(71) Applicant: Insight Lighting, Inc., Rio Rancho, NM (US)

(72) Inventors: Jaxon Patterson, Rio Rancho, NM (US); Steve Kellison, Rio Rancho, NM (US); David Patterson, Rio Rancho, NM (US)

(73) Assignee: INSIGHT LIGHTING, INC., Rio Rancho, NM (US)

( * ) Notice: Subject to any disclaimer, the term of this patent is extended or adjusted under 35 U.S.C. 154(b) by 0 days.

(21) Appl. No.: 16/396,338

(22) Filed: Apr. 26, 2019

(51) Int. Cl.
*F21V 3/06* (2018.01)
*F21V 21/008* (2006.01)
*F21Y 115/10* (2016.01)

(52) U.S. Cl.
CPC ..... *F21V 3/0625* (2018.02); *F21V 21/008* (2013.01); *F21Y 2115/10* (2016.08)

(58) Field of Classification Search
CPC .... F21V 3/0625; F21V 21/008; F21V 21/005; F21V 5/002; F21V 5/004; F21V 5/005; F21V 5/007; F21V 5/008; F21V 5/08; F21Y 2115/10; F21Y 2103/10; F21K 9/64; F21S 4/28; F21S 2/005
See application file for complete search history.

(56) References Cited

U.S. PATENT DOCUMENTS 6,582,103 B1 * 6/2003 Popovich ..... F21V 5/046 362/307
10,222,052 B1 * 3/2019 Ter-Hovhannisyan ..... F21S 8/061
10,240,760 B1 * 3/2019 Lehman ..... F21S 8/00
10,323,837 B2 * 6/2019 Hierzer ..... F21V 21/35
10,443,823 B2 * 10/2019 Beland ..... E04B 9/006
10,663,122 B1 * 5/2020 Zheng ..... F21V 5/008
2011/0297971 A1 * 12/2011 Shimizu ..... F21V 13/04 257/88
2012/0092875 A1 * 4/2012 Cho ..... F21S 2/005 362/311.01
2012/0106143 A1 * 5/2012 Yeh ..... F21V 15/015 362/217.05
2013/0021792 A1 * 1/2013 Snell ..... F21V 7/0016 362/218
2014/0092596 A1 * 4/2014 Deutsch ..... F21V 5/007 362/236

(Continued)

*Primary Examiner* — Erin Kryukova
(74) *Attorney, Agent, or Firm* — Rod D. Baker

(57) ABSTRACT

A lighting apparatus and system which employs LED boards as a light source, as well as diffusers for casting light toward workspaces and other areas of interest. The apparatus is modular to permit the system to be adaptively configured in a wide variety of arrangements. An apparatus module has a housing assembly mounting a direct light LED board, a diffuser, and a hub connecting the housing assembly to the diffuser and holding the diffuser and housing assembly in spaced-apart relation. By the apparatus, the direct light LED board projects light from the housing assembly and across a separation distance toward the diffuser. The diffuser receives the direct light and diffuses the direct light from the module. Light originates in the housing assembly, is transmitted to the diffuser, and the diffused light is then projected from the module for illuminating the surrounding environment.

18 Claims, 6 Drawing Sheets

(56) References Cited

U.S. PATENT DOCUMENTS

| | | | | |
|---|---|---|---|---|
| 2015/0226384 | A1* | 8/2015 | Park | F21V 21/34 362/223 |
| 2015/0233533 | A1* | 8/2015 | Van Es | F21S 8/043 313/49 |
| 2016/0195250 | A1* | 7/2016 | Park | F21S 2/005 362/219 |
| 2018/0128450 | A1* | 5/2018 | Kaminski | F21V 17/164 |
| 2018/0172257 | A1* | 6/2018 | Hierzer | F21S 4/28 |
| 2018/0313503 | A1* | 11/2018 | Sonneman | F21S 8/063 |
| 2019/0088241 | A1* | 3/2019 | Czech | F21S 8/043 |
| 2019/0338924 | A1* | 11/2019 | Vang | F21V 7/005 |
| 2020/0018448 | A1* | 1/2020 | Hanslip | G02B 5/0278 |
| 2020/0141545 | A1* | 5/2020 | Gielen | F21V 21/008 |

* cited by examiner

FIG. 5A
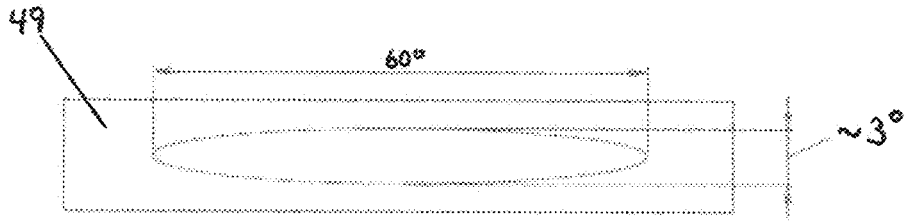
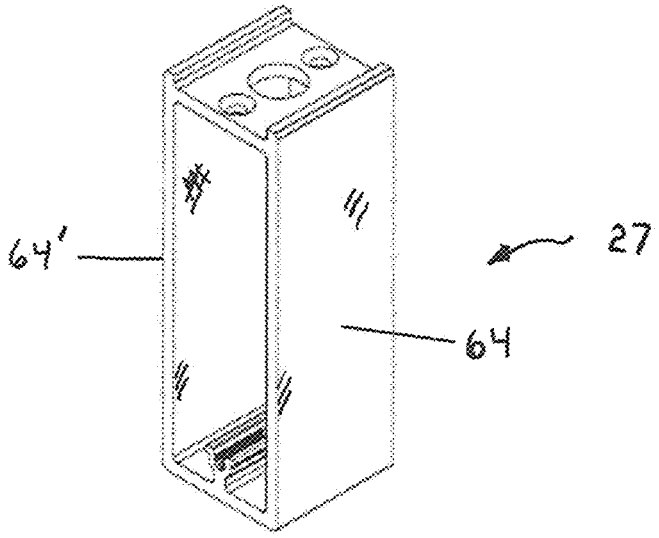
FIG. 7
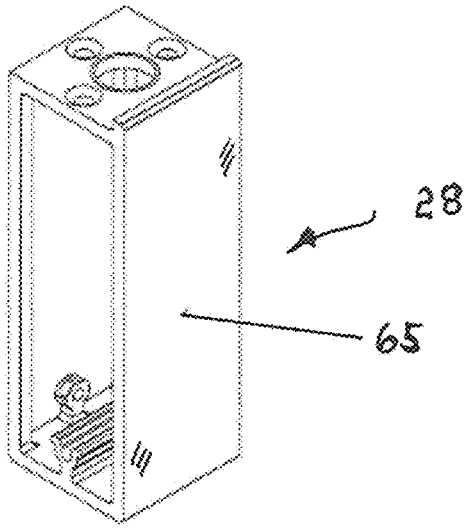
FIG. 8

MODULAR LED LIGHT FIXTURE WITH SPACED DIFFUSER

BACKGROUND OF THE INVENTION

Field of the Invention

This invention relates to lighting sources and fixtures, and particularly to light fixtures using light emitting diodes and diffusers.

Background Art

Artificial light sources and fixtures have long been known for illuminating the interiors and exteriors of structures, buildings, and dwellings. Light sources using light emitting diodes (LED) as light sources are known. LED boards are commercially available as light sources, and multiple LED boards may be arranged in various configurations and arrays to provide light from a lighting device or fixture. It also is known to employ various types of diffuser components in cooperation with light sources, so to diffuse and scatter the projected light to improve the quality and pleasantness of the provided light.

"Down lights" transmit light mostly downward to illuminate areas of interest. Down lights have been previously devised which include a diffuser and a light source within a housing. Down lights typically combine the housing and diffuser in proximity to each other, into an integrated fixture assembly. Such integrated designs result in mundane aesthetics. More significantly, such integrated designs normally are unitary and non-modular, presenting substantial aesthetic and functional barriers against creating long continuous "runs" of fixtures, or angled corner configurations, of these products—either in field installations or during manufacturing. Traditional lighting fixtures do not use open air as a design element of the fixture.

SUMMARY OF THE DISCLOSURE

There is disclosed a lighting apparatus and system which employs LED boards as a light source, as well as diffusers for efficiently and pleasantly casting light toward workspaces and other areas of interest. The present apparatus and system are modular in character to permit the system to be adaptively configured in a wide variety of arrangements and arrays. Moreover, the apparatus is visually aesthetic and readily harmonized with a wide assortment of interior design schemes and architectural regimes.

Broadly characterized, the invention includes a lighting apparatus comprising at least one module having a longitudinal axis and including: (1) a housing assembly mounting a direct light LED board; (2) a diffuser; and (3) a hub connecting the housing assembly to the diffuser and holding the diffuser and housing assembly in spaced-apart relation, there being a separation distance between the diffuser and the housing assembly. In and by this apparatus, the direct light LED board projects light from the housing assembly and across the separation distance toward the diffuser, and the diffuser receives the direct light and diffuses the direct light from the module. Light originates in the housing assembly, is transmitted to the diffuser, and the diffused light is then projected from the module for illuminating the surrounding environment. Two or more modules may be combined in series in a wide variety of lighting system configurations. The modularity of the modules and a variety of hub configurations contribute to possible lighting systems of wide variety and versatility.

Further features of the present invention will be apparent from the following description of exemplary embodiments with reference to the attached drawings.

BRIEF DESCRIPTION OF THE DRAWINGS

Embodiments of the invention can be better understood with reference to the following drawings, which form part of the specification and represent preferred embodiments. The drawings are not necessarily to scale (either within a view or between views), emphasis instead being placed upon illustrating the principles of the invention. In the drawings, like reference numerals designate corresponding elements throughout the several views. In the drawings:

FIG. 5A is an enlarged plan view of a pane and elliptical shaping film usable in an apparatus according to the present invention;

FIG. 7 is a top perspective view of a two-way joiner hub usable in alternative embodiments of systems according to the present invention;

FIG. 8 is a top perspective view of a three-way joiner hub usable in alternative embodiments of systems according to the present invention.

DETAILED DESCRIPTION OF THE INVENTION

There is provided according to the present disclosure an invention for lighting areas of interest within or about buildings, dwellings, or other structures. The invention may have utility in any of a wide variety of locales and circumstances, although it is contemplated that the invention will find particularly desirable use within residential homes and commercial and/or industrial buildings. It is understood, however, that the invention is not so limited. The present disclosure offers a new approach to the general archetype of a "down light."

Designed for architectural lighting applications, the apparatus and system may be installed in commercial spaces to be used as a general lighting tool. The apparatus and system may provide down light or, optionally, up-and-down light throughout a space in either a spectrum of white lights or color-changing lighting. It is contemplated that the apparatus is what is known as an "A-type" fixture: a lighting tool that is the primary light source throughout a commercial or industrial space and is the principle fixture in an installation. A-type fixtures provide the standard lighting throughout a space and, are usually complimented or supplemented by other satellite fixtures with more specific or personal lighting intent or tasks. Some installations according to the present invention may be one or more single-module fixtures, independent of each other, above work stations or in hallways. The invention includes the option for continuous runs of serially connected fixture modules, which could be used, for example, down the center of a hallway in long runs without breaks between modules. Multiple module fixtures may also be used to create rectangular shapes, which could take the form of independent hanging installations, or used as right angles to wrap around hallway corners.

Also disclosed hereby is an optical solution to transfer light through the open air and illuminate a physically separated transmissive body. This apparatus and system create a visual relationship of an opaque housing assembly, a negative space, and an illuminated diffuser—all potentially of equal dimensions. Cables from which the apparatus/system is suspended have integrated wiring which allow the power and control signals to be transferred internally, providing a cleaner "look" for the apparatus overall.

In the apparatus, a lens or diffuser is spaced apart and separated from a light source housing assembly, and in so doing creates an appealing and functional lighting module apparatus. Multiple lighting modules can be combined together to form large lighting installations. A module combines a housing assembly and a diffuser, with open air space between them as graphical elements. Accordingly, the invention provides not only a functional lighting module and modular system, but also a visually aesthetic lighting tool.

Figure 1:
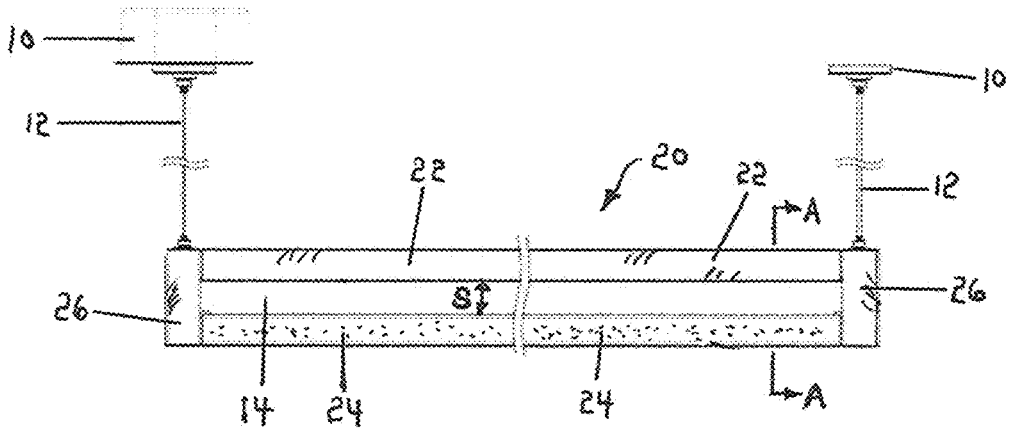
FIG. 1 is a side diagrammatic view of a modular lighting apparatus according to the present invention, shown as a module would appear when suspended from a ceiling or other overhead support; the diagram is a broken view, with break lines indicating that a single module may have any of many lengths, and that its suspension cables can have any suitable selected length.
Figure 2:
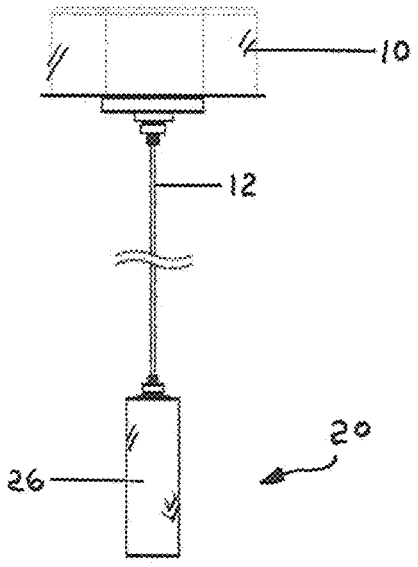
FIG. 2 is an enlarged end view of the module shown in FIG. 1.

Combined reference is invited to FIGS. 1 and 2, depicting a single module 20 according to this apparatus and system. In a preferred embodiment, each module 20 is suspended from a ceiling 10 or other suitable supporting structure. At least one, preferably at least two, power suspension cables 12 are securely attached to the ceiling 10 to hang the module 20, and preferably supply electrical power from the electrical grid or other power source to the module 20. A single module 20 as seen FIGS. 1 and 2 has a hub 26 on each end of the module, to which a suspension cable 12 is connected; power is delivered from the cable into at least one of the hubs 26 for powering the electrical components and light source of the module. The cables 12 can be adapted to suitable length to locate the module 20 an appropriate distance below the ceiling 10, and a selected distance above the areas and workspaces to be illuminated. A module 20 may fabricated to have any of many lengths; standard axial lengths may range from nominal 24 inches to 96 inches, in 12-inch increments.

Hubs are used to connect the ends of modules together, or to close or cap the ends of a single module. Hubs may contain and channel electrical components, e.g., wire. The hub 26 on the end of a module, or shared by two modules, serves as termination point for a module 20 but also as a mounting point for a suspension cable 12. A hub 26 can also be adapted for use as a thorough-way section for continuous runs of lighting modules, or a corner component for square installations. Again, the hub 26 is connected to the suspension cable 12 that transfers electrical power through the hub to the module 20.

In a typical embodiment, a module 20 includes a housing assembly 22, a diffuser 24 and the two hubs 26. FIGS. 1 and 2 show that in a normal usage, the module 20 is elongated along a substantially horizontal, longitudinal, (imaginary) axis. The hubs 26 support the module 20 by their connection to the cables 12. Hubs 26 are connected to the respective ends of the module 20 to hold the housing assembly 22 and the diffuser 24 substantially parallel to each other, the housing assembly 22 being situated above the diffuser 24. By way of example only, both the housing assembly 22 and the diffuser 24 may be about 1.25 inches in height and in lateral width, and may be separated by a gap of 1.25-inch separation distance. The hubs 26 thus maintain the housing assembly 22 and the diffuser 24 in a spaced-apart relation. A vertical separation distance S separates the bottom surface of the housing assembly 22 from the top surface of the diffuser 24. In a preferred embodiment where the housing assembly 22 and the diffuser 24 are each about 1.25 inches in height, the separation distance S also is about 1.25 inches. Light sources within the housing assembly 22 project light from the bottom of the housing assembly 22 to the diffuser 24 below. The light energy is then diffused by the diffuser and transmitted to the areas around and below the module 20. The light emitted down from the housing assembly 22 is transmitted the distance S and across the open space 14 between the housing assembly and the diffuser 24, to be received by the diffuser. "Open space" in this disclosure and in the claims means that there are no components or elements of the apparatus to either side of the space 24 between the housing assembly and the diffuser; rather, the only elements of a module 20 that span the open space 14 are the hubs 26 at the ends of a module. There is only open air to occupy the space between the inside surfaces of the hubs 26 and between the bottom surface of the housing assembly 22 and the top surface of the diffuser 24.

The module 20 having a longitudinal axis features as its principal components the housing assembly 22 (mounting a direct light LED board 32, FIG. 5), the diffuser 24, and one or more hubs 26 connecting the housing assembly to the diffuser. The hubs 26 hold the diffuser 24 and housing assembly 22 in spaced-apart relation, there being the separation distance S between the diffuser and the housing assembly. The direct light LED board 32 in/on the housing assembly 22 projects direct light from the housing assembly and across the separation distance S toward the diffuser 24, and the diffuser receives the direct light and diffuses the direct light from the module 20. The provided light may be standard white lighting, correlated color temperature (CCT) from 2700K to 5000K or RGB/RGBW.

An advantageous benefit of the general apparatus and system is its modularity. Two or more modules 20 may be interconnected to provide compound, more sophisticated, configurations whereby extended runs of lighting fixture may be supplied to larger areas to be illuminated. By connecting two or more modules 20 end-to-end, serial combinations of modules can be configured in a wide variety of linear or squared lighting system runs. This yields a versatility that permits systems according to the present invention to be adapted to the circumstances and environment where illumination is provided. Linear and squared runs can be arranged to maximize lighting to needed areas in a room or rooms, along a hallway, etc. Any of a myriad of potential configurations of modules 20 may be planned and selected to efficiently optimize the illumination of desired areas, as well as to harmonize the lighting system to the architecture and interior (or exterior) design of the areas and spaces to be lit up.

Figure 3:
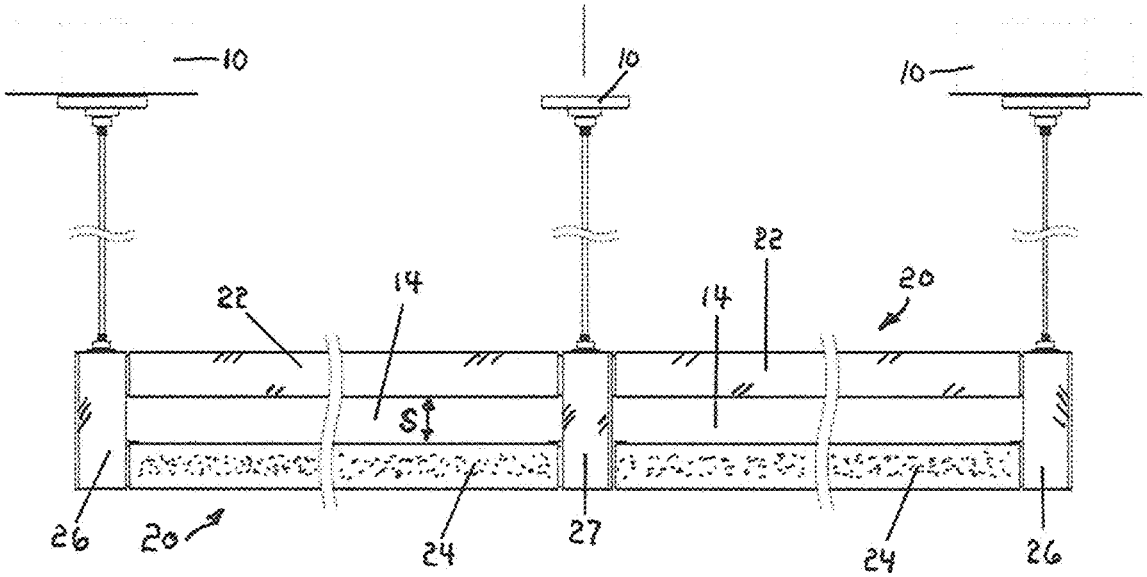
FIG. 3 is a side diagrammatic view of an apparatus and system according to the present invention, illustrating two lighting modules connected in series to create a longer, linear, "run" of lighting.

Reference is made to FIG. 3, showing a basic linear specification of a lighting run system composed of two modules 20 including three hubs 26, 27. The hubs 26, 27 preferably are connected to the ceiling 10, as previously explained. There is a hub 26 at an end of each module 20, as well as a shared joiner hub 27 (see also FIG. 7) that connects the modules 20. A person skilled in the art immediately appreciates that a plurality of two, three, or more modules 20 may be serially connected to provide lengthier runs of linear lighting fixture, as long as may be desired and selected according to circumstantial need.

Figure 4:
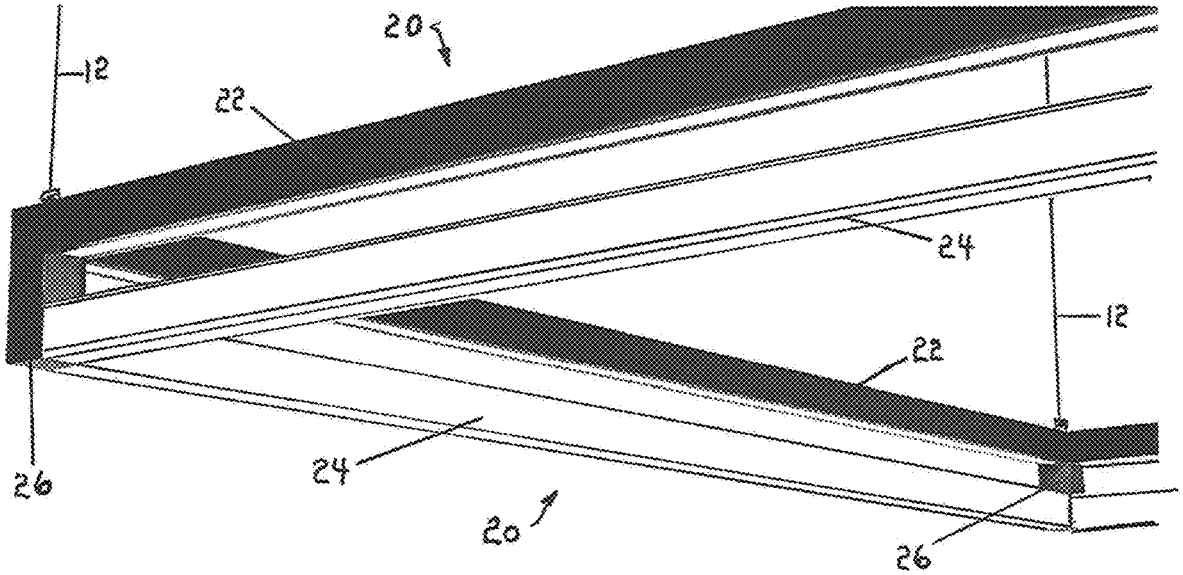
FIG. 4 is a bottom perspective view of an apparatus and system according to the present invention, illustrating a how a plurality of modules may be connected end-to-end to create a longer "run" of lighting in which the system defines corners, so the plurality of modules is arranged to define squares or rectangles.

Referring to FIG. 4, it is seen also that one or more specially configured corner hubs 26 may be used with two or multiple modules 20 to construct lighting systems with angled corners. A portion of a relatively simple squared specification of a lighting run according to the invention is seen in FIG. 4, with each corner hubs 26 shared by an operatively adjacent pair of modules 20 in the system. A person skilled in the art immediately appreciates that a plurality of two, three, or more modules 20 may be serially connected to provide runs of linear lighting fixtures that define an overall square, or rectangular configuration, and illuminating an area as large as may be desired and selected according to circumstantial need. Corner hubs 26 could also be used to connect two modules in an L-shaped configuration. Or, three or more modules connected by intermediate corner hubs arranged in alternating orientations could compose a zig-zag configuration for the lighting run. The various configuration possibilities for a lighting system run comprised of a plurality of modules 20 is expansive and almost endless, due to the versatility of the modular design of the invention.

A system according to the present invention thus optionally includes an apparatus having two modules 20 joined by a shared hub 27. In such systems, the longitudinal axes of the two modules 20 may be substantially collinear. Alternatively, the longitudinal axes of the two modules may define an angle, most commonly a right angle (90 degrees). It readily is understood that more complex systems have more than two modules, and the plurality of such modules can be interconnected and arranged in a wide variety of special and geometric configurations by associating modules end-to-end.

Figure 5:
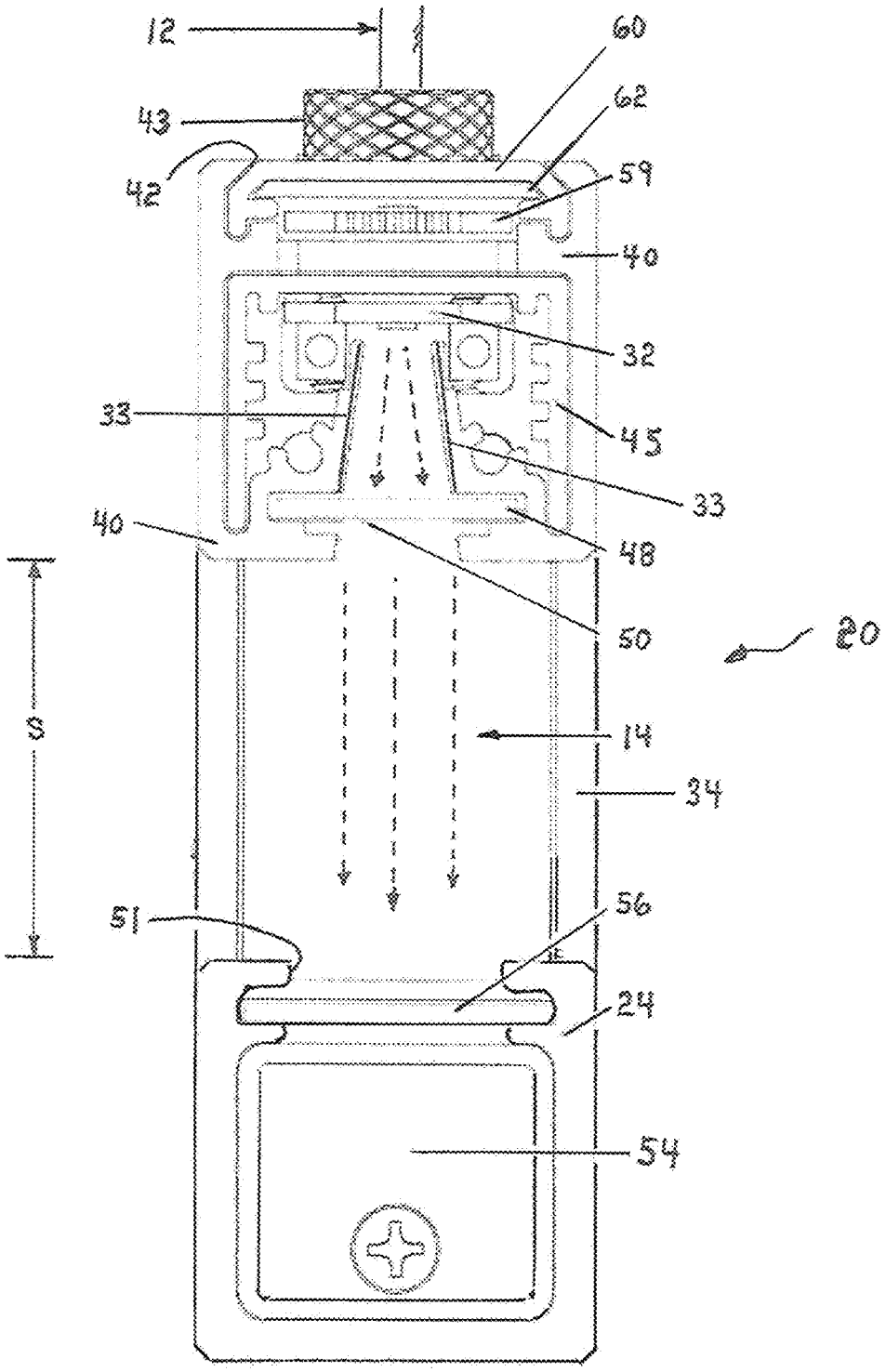
FIG. 5 is an enlarged sectional view of a light module, taken along line A-A of FIG. 1.
Figure 6:
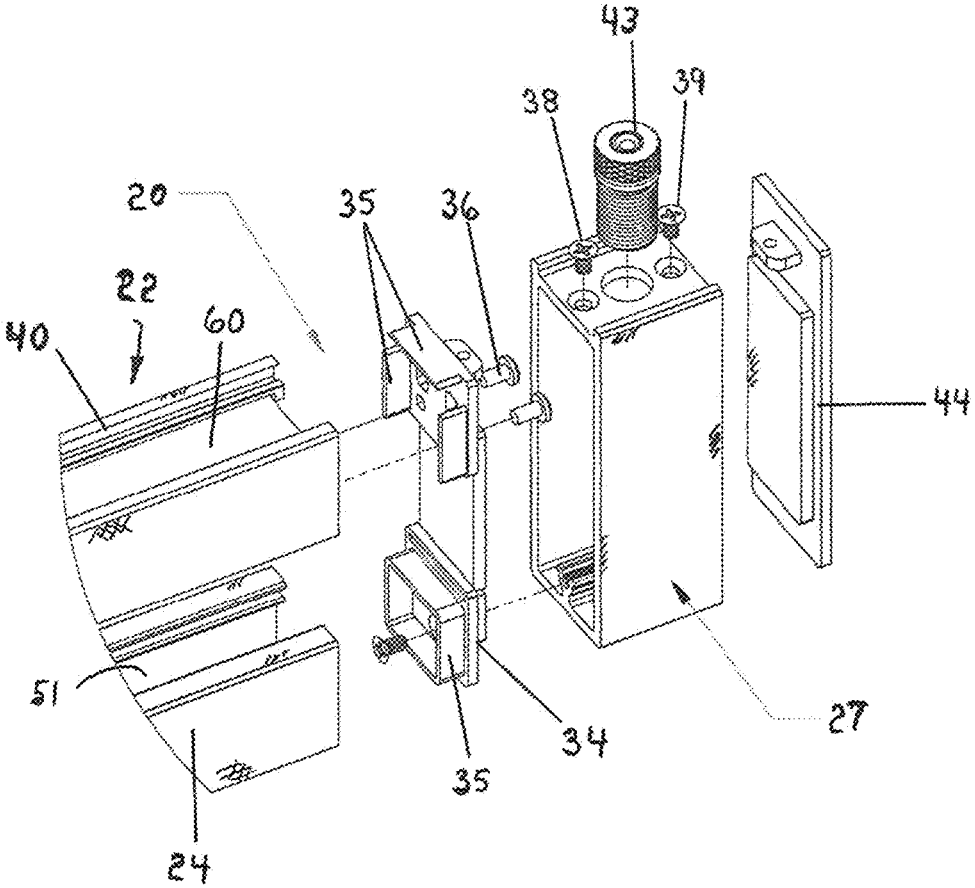
FIG. 6 is an exploded perspective view of an end portion of a module, showing the connection of a hub to an end of a housing assembly and an end of a diffuser.

Additional understanding of an apparatus according to the present disclosure may be had with combined referenced to FIGS. 5 and 6, the former providing an enlarged vertical sectional view of a single module 20. A detailed description of a single module 20 serves generally to describe any module of the plurality of modules that may be combined in a multi-module system. As explained previously, a module 20 includes as principal elements a housing assembly 22 above a diffuser 24. The bottom of the housing assembly 22 is situated the separation distance S (e.g., approximately 1.25 inches) above the top of the diffuser 24. The housing assembly 22 has for its principal body a rigid housing 40 shaped as a long hollow tube with a generally square vertical cross section, defining an interior space therein. The housing 40 may be composed of a lightweight metal, and in one preferred embodiment is fabricated from extruded aluminum. The bottom of the housing 40 has a longitudinal first outlet aperture 41 therein which is in confronting relation to, but spaced-apart from, the diffuser 24. The outlet aperture 41 preferably runs the complete longitudinal length of the housing 40. The housing 40 has at least one LED board 32 light source, and various other functional components attached thereto or contained therein, as shall be described further, to constitute the housing assembly 22. The diffuser 24 also is shaped as a long hollow tube with a generally square vertical cross section, defining an interior space 54 therein. The top of the diffuser 24 defines a longitudinal inlet aperture 51 in confronting relation to, but spaced-apart from, the housing 40. The inlet aperture 51 runs the entire length of the top of the diffuser 54 and preferably is vertically aligned with the housing's first outlet aperture 41. In use, the housing's first outlet aperture 41 and the diffuser's inlet aperture 51 are in mutual registration on opposite sides of the open space 14 between the housing assembly 22 and the diffuser 24. The diffuser 24 is composed of a translucent plastic of any selected color, and preferably is fabricated from an extruded acrylic. The diffuser transmission includes the options of having the diffuser be 90% transparent, or more opaque to better refract color.

The dashed direction lines/arrows in FIG. 5 illustrate the direct light rays that are transmitted across the open space 14 across the separation distance S between the housing assembly 22 and the diffuser 24.

Referring to FIG. 6, each of the two ends of the housing assembly 22 preferably is connected to the corresponding ends of the diffuser 24 by means of a joiner 34. The housing assembly 22 and diffuser 24 are held together by the intelligent joiner 34 component, which fastens to the housing 40 and holds together the core of a light-generating module. The joiner 34 allows wire to pass through, but also serves as the mating components for the modular hubs 26, 27. For longer sections of a diffuser, a small transparent clip (not shown) may be provided near the middle of a module 20 to prevent the diffuser from sagging. The joiner 34 is a thin rigid panel (e.g., rolled, bent, and hole-punched aluminum) having peripheral dimensions corresponding to the those of the proximate open side of a hub 26. The joiner 34 may have suitable tabs or flanges 35 extending from its proximate side. The plurality of flanges 35 are sized, shaped and arranged to engage closely with corresponding interior end surfaces of the square tubular housing 40 and of the square tubular diffuser 24. Adhesives and/or various fasteners 36 (e.g., rivets, screws) may be used respectively to securely connect the end of the diffuser 24 to the joiner 34, and to securely connect the end of the housing assembly 22 to the joiner.

A hub, such as the two-way hub 27 of FIG. 6, is fabricated, for example, from extruded aluminum. In a preferred embodiment, each hub 27 (or hub 26 of FIGS. 1-4) is hollow with a rectangular vertical cross section. FIG. 6 illustrates that a hub of a module 20 may be fashioned in the form of a two-way hub 27. At each end of a single module 20, the respective joiner 34 is reliably connected to the hub 27 using, for example, a fastener 37 through the joiner for screwed engagement with the hub 27. Hub 27 may be provided with a suitable ear or socket for receiving the fastener 37, as depicted in FIG. 6. There may also be one or more fastener holes in the top of the hub 27 whereby fasteners 38, 39 can be used to attach a joiner 34 to the hub, and/or to attach a cap plate 44 to the hub.

The top wall of each hub 26, 27 also defines a central hole into which a cable connecter 43 (with appropriate wire gripper) is reliably secured (e.g., by a threaded screwed engagement). The cable connector 43 is connected to the bottom end of a suspension cable 12 (e.g., FIGS. 1-3) by which a hub 27 is hung from an overhead support 10, and for delivering electrical power into the hub. When a hub 27 is used to close the end of a single module 20, as suggested by FIG. 6, there is provided a cap plate 44 for closing the open side of the two-way hub 27, opposite the joiner 34. The cap plate 44 may be attached to the hub 27 by a fastener 39, for example. Fastener 38 may penetrate the top of the hub 27 to help attach the hub and joiner 34 together.

Combined reference is made to FIGS. 5 and 6, particularly FIG. 5, for additional disclosure of the form and function of the housing assembly 22. The housing 40 of the housing assembly defines an interior for holding and arranging the operational elements of the light engine. The housing 40 defines, longitudinally along its bottom, the first outlet aperture 41. Optionally but preferably there also is defined in the top of the housing, longitudinally along its length, an upper second outlet aperture 42. Suitable fasteners, bezels and tabs may be provided by and within the housing 40 (including by an extruded aluminum substrate 45 cabined within in the housing 40 and surrounding its interior on three sides) for positioning and mounting various components. At least one, preferably a plurality, of direct LED light boards 32 (one shown) is disposed within the housing 40 along its length. It is understood that while one direct light LED board 32 is seen in FIG. 5, in the preferred embodiment a plurality of LED boards is disposed within the housing 40. "At least one" or "an" LED board accordingly refers in the preferred embodiment to a plurality of LED boards arranged end-to-end in a series along substantially the full length of the housing assembly 22, and in parallel registration with the nearby first outlet aperture 41 along its length. The light beam emitted from a given LED board 32 overlaps with the beam from an adjacent LED board, so that light rays are substantially uniformly emitted down from the first outlet aperture 41 along its length.

When electrically powered, the light boards 32 generate downwardly transmitted direct light of a selected intensity and wavelength. The LED board 32 projects direct light (see dashed lines in FIG. 5) downward through the interior of the housing 40, from along its length, which direct light is then controlled by optical films/plastics that are disposed on and along the the bottom of the housing very near the longitude of the first outlet aperture 41.

More specifically, and still referring to FIG. 5, the direct light emitted by the light boards 32 is directed to a clear transparent pane 48 with a thin optical elliptical shaping film 49 (FIG. 5A) thereon. The transparent pane 48 runs the length of the outlet aperture 41, and preferably is composed from a thin (e.g., approximately 0.06-inch) rigid panel of acrylic plastic. Substantially immediately adjacent to the transparent pane 48 is situated a thin linear optical shaping film 50. The linear shaping film 50 is commercially available, and collimates the direct light that passes through the pane 48 and elliptical shaping film 49. The elliptical shaping film 49 reshapes the direct light from the LED board 32 into a beam having an elliptical cross section to promote efficient transmission of direct light from the bottom of the housing assembly 22. FIG. 5 illustrates that in a preferred embodiment, the transparent pane 48 with elliptical shaping film 49 affixed thereon is nearby the first outlet aperture 41, while the linear shaping film 50 is below the pane and the elliptical shaping film, and substantially proximate to the housing's first outlet aperture.

In a preferred embodiment, the housing 40 is extruded to provide a symmetric pair of reflector flanges 33 which extend at an angle into the interior of the housing. The reflector flanges 33 run the length of the housing 40; between the distal ends of the reflector flanges is a gap through which the direct light passes in route from the LED board 32 to the transparent pane 48. In the preferred embodiment, the inner surfaces of the reflector flanges 33 are highly polished or otherwise efficiently reflective, so to reflect (inward and mostly downward) any direct light impinging thereon, towards the transparent pane 48 and elliptical shaping film 49. Thus, the two films 49, 50 allow for the direct light beams to exit the housing 40 uniformly, and to illuminate the length of the diffuser 24 suspended below in an efficient and optically appealing manner.

FIG. 5A depicts information for the elliptical shaping film 49 on the transparent pane 48. The elliptical shaping film 49 shapes and redirects the direct light it receives from an LED board 23. Suitable example elliptical shaping film 49 is available from Bright View Technologies, of Durham, N.C., as part number is E-6001-PE-S-M-RA06R. The figure shows how the direct light beam impacting the shaping film 49 is shaped into an ellipse, for example an ellipse of about 60° by less than 4°, preferably an ellipse of 60°×1°.

After passing through the pane 48 and films 49, 50, the direct light from an LED board 32, as indicated by the dashed line light rays of FIG. 5, leaves the housing assembly 22 via the first outlet aperture 41. The direct light is transmitted across the open space 14 between the housing assembly 22 and the diffuser 24. The direct light beams, as collimated by the linear shaping film 50, then enter into the interior 54 of the diffuser 24 for diffusion into the surrounding environment.

FIGS. 5 and 6 show the configuration of the diffuser 24, preferably fabricated from a durable acrylic polymer. The diffuser 24 in a preferred embodiment is hollow with a preferably generally rectangular lateral cross section. The top portion of the diffuser 24 defines therein, and along the diffuser's full length, the diffuser inlet aperture 51. The aperture 51 receives into the diffuser's interior 54 the collimated direct light emitted from the housing assembly 22. Direct light passes through the diffuser inlet aperture 51 and into the interior 54, and then is transmitted through the diffuser's translucent walls, thereafter to be emitted diffusely outward and downward into the space to be illuminated. The diffuser inlet aperture 51 preferably is closed/covered along its length with a clearly transparent dust guard 56 to prevent dust and insects and other detritus from entering the diffuser interior 54 via the inlet aperture. The dust guard 56 may be slidably fitted into a lot or bezel in the top of the diffuser 24 at the inlet aperture 51, as seen in FIG. 5. The guard 56 may be composed of, for example, a sheet of VIVAK® brand transparent thermoplastic.

In sum, the apparatus includes the housing assembly 22 with a hollow housing 40 defining a housing interior and a first outlet aperture 41 facing toward the diffuser 24. The direct light LED board 32 is within the housing interior. The housing assembly 22 also includes a transparent pane 48 attached to the housing 40 at the first outlet aperture 41, with an elliptical shaping film 49 mounted upon the transparent pane, whereby the elliptical shaping film shapes into an elliptical beam the direct light from the direct light LED board 32. The housing assembly also has a linear shaping film 50 adjacent the transparent pane 48, which linear shaping film collimates the elliptical beam for projection through the first outlet aperture 41 and uniformly toward the diffuser 24. And, as mentioned, the diffuser 24 defines the diffuser interior 54 and the inlet aperture 51 facing toward the housing assembly 22, so that direct light from the housing assembly 22 enters the diffuser's inlet aperture 51 and is diffused through the diffuser. The diffuser's inlet aperture 51 is aligned with the housing's first outlet aperture 41, with the result that the collimated elliptical beams transmitted down from the housing assembly 22 enter the diffuser's inlet aperture and are diffused away from the module 20.

Optionally, a second light source may be provided within the housing assembly 22 to cast diffused light from the top of a module 20. FIGS. 5 and 6 illustrate that in a preferred embodiment, the top of the housing 40 of the housing assembly 22 defines therein a second outlet aperture 42 opposite the first outlet aperture 41. Another LED board, an indirect light LED board 59, is disposed within the housing interior. The indirect light LED 59 is positioned and held within the housing 40 so to emit indirect light upward toward the second outlet aperture 42. An upper diffuser pane 60 is fastened on the housing at/in the second outlet aperture 42, to diffuse the indirect light projected upward by the indirect light LED 59. Diffuser pane 60 may be composed of a clear or translucent extruded acrylic. There is a film space 62 between the upper diffuser pane 60 and the indirect light LED 59 in which selected optical manipulation film(s) may be added to shape the beam, if desired. Indirect light from the indirect light LED 59 thus passes through the second outlet aperture 42 and the diffuser pane 60, to transmit diffused light into the space above and around the module 20, thereby affecting the environmental ambience, improve aesthetics, and offering indirect lighting to areas below the module.

Accordingly, in the preferred apparatus, the housing 40 defines a second outlet aperture 42 opposite the first outlet aperture 41, and the housing assembly includes the indirect light LED board 59 within the housing interior, and the diffuser pane 60 mounted on the housing at the second outlet aperture. The indirect light LED board 59 projects indirect light to the diffuser pane 60, and the diffuser pane receives the indirect light and diffuses the indirect light from the module 20.

As discussed hereinabove, two or more modules 20 can be combined to compose complex lighting systems. Flexibility and versatility of the multi-module systems is enabled by, among other aspects of the invention, the use of differently configured hubs. A hub can be configured to, for example, join two modules linearly (e.g., hub 27 in FIG. 3) or to join two modules to define with their long axes a 90-degree corner (e.g., hubs 26 and modules 20 in FIG. 4).

A two-way hub 27 is seen in FIG. 7. Two sides of the hub 27 are open, and two sides 64, 64' are closed. The open sides are the sides that are adjacent to and confronting the housing assembly 22 and diffuser 24 when the hub 27 is used to connect together the housing assembly and the diffuser. Two-way hubs 27 can be used to join together the ends of two modules 20 (e.g., FIG. 3). Also, as seen in FIG. 6, a two-way hub 27 may be used in combination with a cap plate 44 to serve as the end hub at an end of a module 20, as indicated by hubs 26 seen in FIGS. 1-3.

FIG. 8 depicts a three-way hub 28. A three way hub 28 has one closed side 65 and three open sides. A three-way hub 28 can be shared by two or three modules 20. Again, the open sides are those sides that are adjacent to and confronting a housing assembly 22 and a diffuser 24 when the hub 28 is used to connect housing assemblies and diffusers together. A three-way hub 28 may be used in cooperation with two housing assemblies 22 and two diffusers 24 to join two modules 20 in a 90-degree angle, in which instance a cap plate 44 (FIG. 6) may be used to close the third (otherwise open) side. Alternatively, a three-way hub 28 can be used to join together three housing assemblies 22 and three diffusers 24 to constitute a T-shaped configuration of three combined modules 20 having the three-way hub 28 in common.

Figure 9:
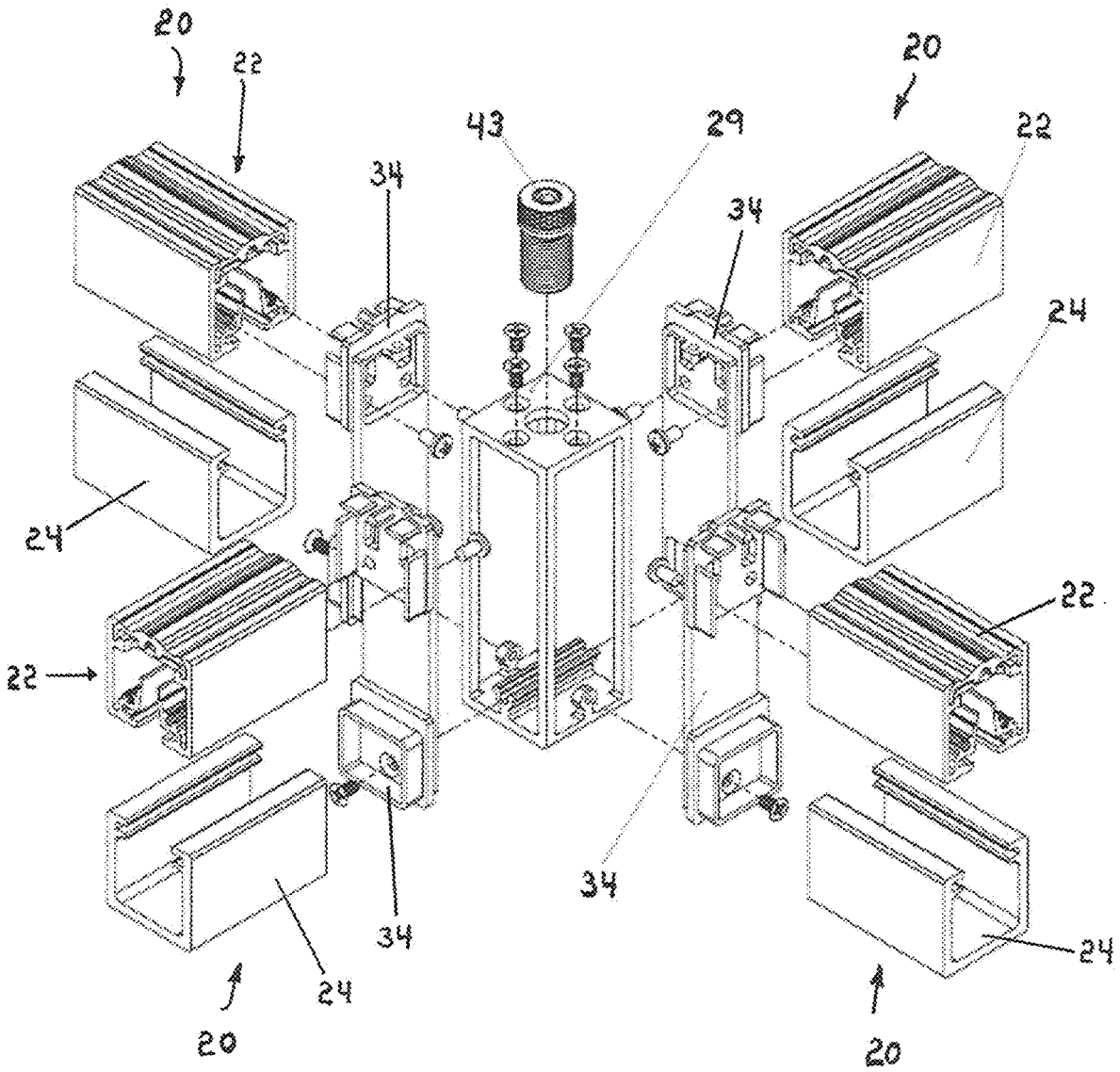
FIG. 9 is an exploded top perspective view of a four-way joiner hub, illustrating how four modules may be connected to the four-way joiner hub to construct an elaborate system according to another embodiment of the present invention.

Reference is turned to FIG. 9, showing how a four-way hub 29 can be employed to construct a cross- or X-shaped lighting system with four modules 20 having the hub 29 in common. Four joiner panels 34 are utilized to connect four housing assemblies 22 and four diffusers 24 to the corresponding four open sides of the four-way hub 29. The four-way hub 29, like any hub, preferably is suspended from overhead by means of a cable (e.g., cable 12 in FIG. 1) secured to the cable connector 43.

By deploying various ones of the two-, three-, and four way hubs (27, 28, 29) to join multiple modules 20, many different configurations of runs of a lighting system may be designed and installed. The number of possible system configurations is nearly limitless, and a multi-module system may be conceived, designed, and installed.

The lighting industry requires a functional product but with a distinct sense of aesthetics to be advantageous in a market that is so closely tied to architecture and interior design. The present invention provides a highly functional and capable lighting fixture with a unique visual experience, while still remaining beneficially minimalist in form and function. Combined with the variety of lighting output options, and with modularity to be either continuous runs or to form rectilinear installations, the apparatus and system are versatile, providing an advantage for a variety of specifications.

Although the invention has been described in detail with particular reference to these preferred embodiments, other embodiments can achieve the same results. The present invention can be practiced by employing conventional materials, methodology and equipment. Accordingly, the details of such materials, equipment and methodology are not set forth herein in detail. In the previous description, specific details are set forth, such as specific materials, structures, processes, etc., in order to provide a thorough understanding of the present invention. However, as one having ordinary skill in the art would recognize, the present invention can be practiced without resorting to the details specifically set forth. In other instances, well known structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents.

What is claimed is:

1. A lighting apparatus comprising:

a module having two ends and a longitudinal axis and comprising:

a housing assembly;

a direct light LED board within an interior of the housing assembly;

a diffuser below the housing assembly; and two horizontally separated hubs, one of the hubs at each end of the module, the hubs connecting the housing assembly to the diffuser and holding the diffuser and housing assembly in spaced-apart relation, there being an open space and a vertical separation distance between the diffuser and the housing assembly, such that the separation distance separates a bottom surface of the housing assembly from a top surface of the diffuser;

wherein the direct light LED board projects direct light from the housing assembly and across the separation distance and open space toward the diffuser, and the diffuser receives the direct light and diffuses the direct light from the module.

2. An apparatus according to claim 1 comprising two modules joined by a shared hub.

3. An apparatus according to claim 2 wherein the longitudinal axes of the two modules are substantially collinear.

4. An apparatus according to claim 2 wherein the longitudinal axes of the two modules define an angle.

5. An apparatus according to claim 1 wherein the diffuser is hollow and defines:

a diffuser interior; and an inlet aperture facing toward the housing assembly;

wherein direct light from the housing assembly enters the inlet aperture and is diffused through the diffuser.

6. An apparatus according to claim 1 wherein the housing assembly further comprises:

a hollow housing defining the housing assembly interior and a first outlet aperture facing toward the diffuser;

a transparent pane attached to the housing at the first outlet aperture; and an elliptical shaping film mounted upon the transparent pane;

wherein the elliptical shaping film shapes into an elliptical beam the direct light from the direct light LED board.

7. An apparatus according to claim 6, further comprising a linear shaping film adjacent the transparent pane, which linear shaping film collimates the elliptical beam for projection through the first outlet aperture and toward the diffuser.

8. An apparatus according to claim 7 wherein the diffuser is hollow and defines:

a diffuser interior; and an inlet aperture aligned with the first outlet aperture;

wherein the collimated elliptical beam from the housing assembly enters the inlet aperture and is diffused through the diffuser and away from the module.

9. An apparatus according to claim 6 wherein the housing defines a second outlet aperture opposite the first outlet aperture, and further comprising:

an indirect light LED board within the housing interior; and a diffuser pane mounted on the housing at the second outlet aperture;

wherein the indirect light LED board projects indirect light to the diffuser pane, and the diffuser pane receives the indirect light and diffuses the indirect light from the module.

10. A lighting apparatus comprising a module having a longitudinal axis and comprising:

a diffuser;

a housing assembly comprising:

a hollow housing defining a housing interior and a first outlet aperture facing toward the diffuser;

a direct light LED board within the housing interior;

a transparent pane attached to the housing at the first outlet aperture; and an elliptical shaping film mounted upon the transparent pane, wherein the elliptical shaping film shapes into an elliptical beam direct light from the direct light LED board; and a hub connecting the housing assembly to the diffuser and holding the diffuser and housing assembly in spaced-apart relation, there being a separation distance between the diffuser and the housing assembly;

wherein the direct light LED board projects direct light from the housing assembly and across the separation distance toward the diffuser, and the diffuser receives the direct light and diffuses the direct light from the module.

11. An apparatus according to claim 10 comprising two modules joined by a shared hub.

12. An apparatus according to claim 11 wherein the longitudinal axes of the two modules are substantially collinear.

13. An apparatus according to claim 11 wherein the longitudinal axes of the two modules define an angle.

14. An apparatus according to claim 10 wherein the diffuser is hollow and defines:

a diffuser interior; and an inlet aperture facing toward the housing assembly;

wherein direct light from the housing assembly enters the inlet aperture and is diffused through the diffuser.

15. An apparatus according to claim 10, further comprising a linear shaping film adjacent the transparent pane, which linear shaping film collimates the elliptical beam for projection through the first outlet aperture and toward the diffuser.

16. An apparatus according to claim 15 wherein the diffuser is hollow and defines:

a diffuser interior; and an inlet aperture aligned with the first outlet aperture;

wherein the collimated elliptical beam from the housing assembly enters the inlet aperture and is diffused through the diffuser and away from the module.

17. An apparatus according to claim 10 wherein the housing defines a second outlet aperture opposite the first outlet aperture, and further comprising:

an indirect light LED board within the housing interior; and a diffuser pane mounted on the housing at the second outlet aperture;

wherein the indirect light LED board projects indirect light to the diffuser pane, and the diffuser pane receives the indirect light and diffuses the indirect light from the module.

18. A lighting apparatus comprising:

a module having a longitudinal axis and comprising:

a diffuser;

a housing assembly comprising:

a direct light LED board;

a first outlet aperture;

a transparent pane attached to the housing; and a linear shaping film adjacent the transparent pane, which linear shaping film collimates a light beam originating from the LED board for projection through the first outlet aperture and toward the diffuser; and two hubs connecting the housing assembly to the diffuser and holding the diffuser and housing assembly in spaced-apart relation, there being a separation distance between the diffuser and the housing assembly;

wherein only open air occupies a space between respective inside surfaces of the hubs and between a bottom surface of the housing assembly and a top surface of the diffuser; and wherein the collimated light beam crosses the separation distance toward the diffuser, and the diffuser receives the beam and diffuses it from the module.

* * * * *